United States Patent [19]

Volk

[11] Patent Number: 4,618,393

[45] Date of Patent: Oct. 21, 1986

[54] HAND LABELING DEVICE

[75] Inventor: Heinrich Volk, Beerfelden, Fed. Rep. of Germany

[73] Assignee: Esselte Pendaflex Corporation, Garden City, N.Y.

[21] Appl. No.: 703,943

[22] Filed: Feb. 21, 1985

[30] Foreign Application Priority Data

Feb. 24, 1984 [DE] Fed. Rep. of Germany ..... 3406810

[51] Int. Cl.[4] ..... B65C 9/46; B65C 11/02

[52] U.S. Cl. ..... 156/384; 101/110; 101/288; 101/291; 156/577; 156/579; 156/DIG. 47; 156/DIG. 49

[58] Field of Search ..... 156/384, 577, 579, DIG. 47, 156/DIG. 49; 101/288, 291, 292, 110, 111

[56] References Cited

U.S. PATENT DOCUMENTS

| | | | |
|---|---|---|---|
| 4,050,375 | 9/1977 | Orlens | 101/288 |
| 4,325,302 | 4/1982 | Beers | 156/384 |
| 4,406,727 | 9/1983 | Fujita | 156/384 |
| 4,450,036 | 5/1984 | Volk | 156/384 |

FOREIGN PATENT DOCUMENTS

| | | | |
|---|---|---|---|
| 2631049 | 1/1977 | Fed. Rep. of Germany | 156/384 |
| 2711919 | 10/1977 | Fed. Rep. of Germany | 156/384 |

*Primary Examiner*—Michael Wityshyn

*Attorney, Agent, or Firm*—Gerald J. Ferguson, Jr.; James E. Bryan; Michael P. Hoffman

[57] ABSTRACT

A hand labeling device for imprinting and dispensing self-adhesive labels comprises a housing (110) in which is disposed a printing mechanism (10) movable between a raised inoperative position and a lowered printing position. The printing mechanism comprises a plurality of axially adjacent setting wheels (16) with which type carriers (20) carrying printing types (22) are in a drive connection. A setting shaft (42) extending in the direction of the axis of the setting wheels (16) and connected to the printing mechanism (10) projects outwardly at a housing wall (110*a*); it is displaceable at a side face of the printing mechanism (10) between an inserted and an extended position and with the aid of said shaft the setting wheels (16) can be adjusted relatively to each other in such a manner that desired printing types (22) on the type carriers (20) move into a printing zone at the printing mechanism (10). Connected to the setting shaft (42) is a stop body (128) which extends parallel thereto and is displaceable with the setting shaft (42) between an extended and an inserted position. In the path which the stop body (128) describes in the extended condition when the printing mechanism (10) is lowered into the printing position a stop edge (126) fixed with respect to the housing is disposed.

6 Claims, 3 Drawing Figures

HAND LABELING DEVICE

Figure 1:
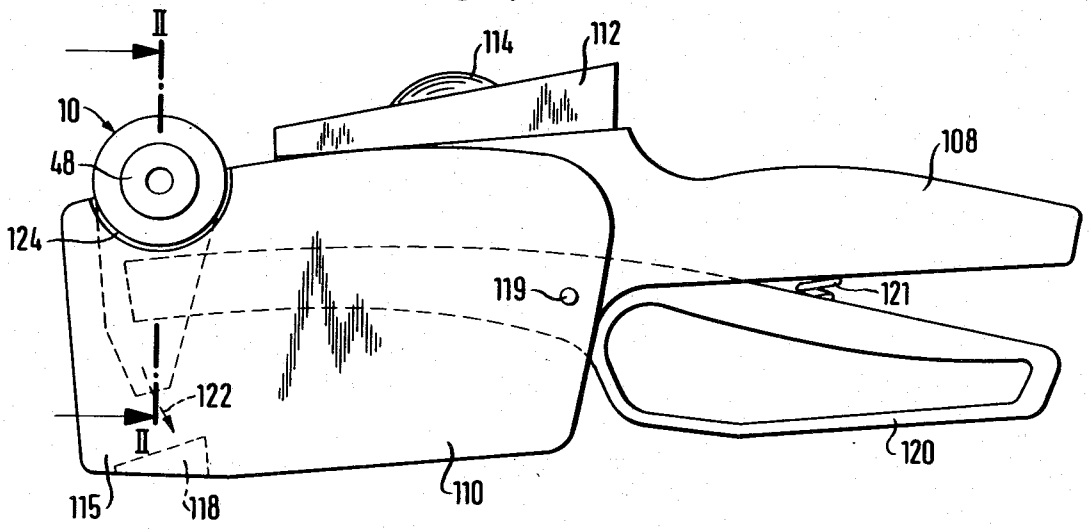

The invention relates to a hand labeling device for imprinting and dispensing self-adhesive labels comprising a housing, a printing mechanism which is movable therein between a raised inoperative position and a lowered printing position and which comprises a plurality of axially adjacent setting wheels with which type carriers carrying printing types are in a drive connection, and a setting shaft which extends in the direction of the axis of the setting wheels, is connected to the printing mechanism, projects outwardly at a housing wall and is displaceable at a side face of the printing mechanism between an inserted position and an extended position and with the aid of which the setting wheels can be moved relatively to each other in such a manner that desired printing types on the type carriers move into a printing zone at the printing mechanism.

EP-A- 0 070 418 discloses such a hand labeling device. In this hand labeling device a spring-loaded arresting member cooperates with the printing mechanism in such a manner that the latter is blocked in the raised inoperative position as long as the setting shaft is not completely inserted. Due to this blocking the operator is always compelled before actuating the hand labeling device to push the setting shaft in completely because otherwise a lowering of the printing mechanism and thus an actuation of the device is not possible. The arresting member is a separate component to be attached to the device housing or to the printing mechanism housing and must be pressed by a separate spring into a predetermined position. The provision of additional components for obtaining the desired prevention of actuation with the setting shaft pulled out increases the assembly time and this in turn results in increased costs. In addition, these components require additional expenditure in stocking.

The invention is based on the problem of further developing a hand labeling device of the type set forth at the beginning in such a manner that without providing additional loose components the device can only be actuated when the setting shaft is completely inserted.

This problem is solved according to the invention in that to the setting shaft a stop body extending parallel thereto is connected which is displaceable with the setting shaft between an extended and an inserted position and that in the path which the stop body describes in the extended condition when the printing mechanism is lowered into the printing position a stop edge fixed with respect to the housing is disposed.

If with the hand labeling device according to the invention the setting shaft has been pulled out or extended laterally from the printing mechanism to perform the desired adjustment of the setting wheels and has not been pushed back in again before the first actuation of the device when an attempt is made to actuate the device and lower the printing mechanism into the printing position the stop body connected to the setting shaft strikes against the stop edge disposed in its path of movement. The operator thus cannot operate the device as he intended and is therefore reminded that the setting shaft is still projecting too far laterally out of the housing. Only when the setting shaft is pushed in is the stop body in a position in which the stop edge is no longer in the way of the lowering movement of the printing mechanism. The stop body and the setting shaft form together one component so that to obtain the desired blocking no separate components which could increase the assembly time need be provided in the device.

Advantageous further developments of the invention are characterized in the subsidiary claims. With the further development characterized in subsidiary claim 3 an automatic return of the setting shaft is achieved when the latter is extended only a short distance from the printing mechanism so that on lowering the printing mechanism the conically formed cap comes against the beveled stop edge. By the contact between the stop edge and the cap the setting shaft is automatically fully inserted. Only when the setting shaft is further extended does the blocking action occur, requiring the operator to push in the setting shaft.

Figure 2:
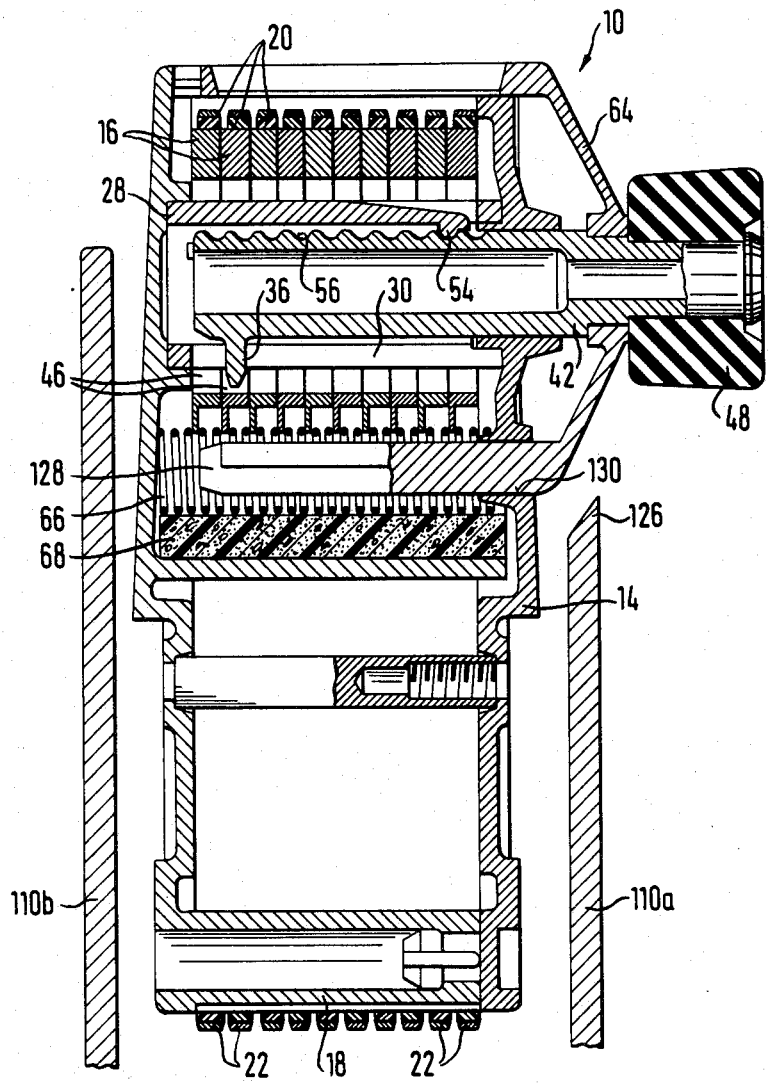
Figure 3:
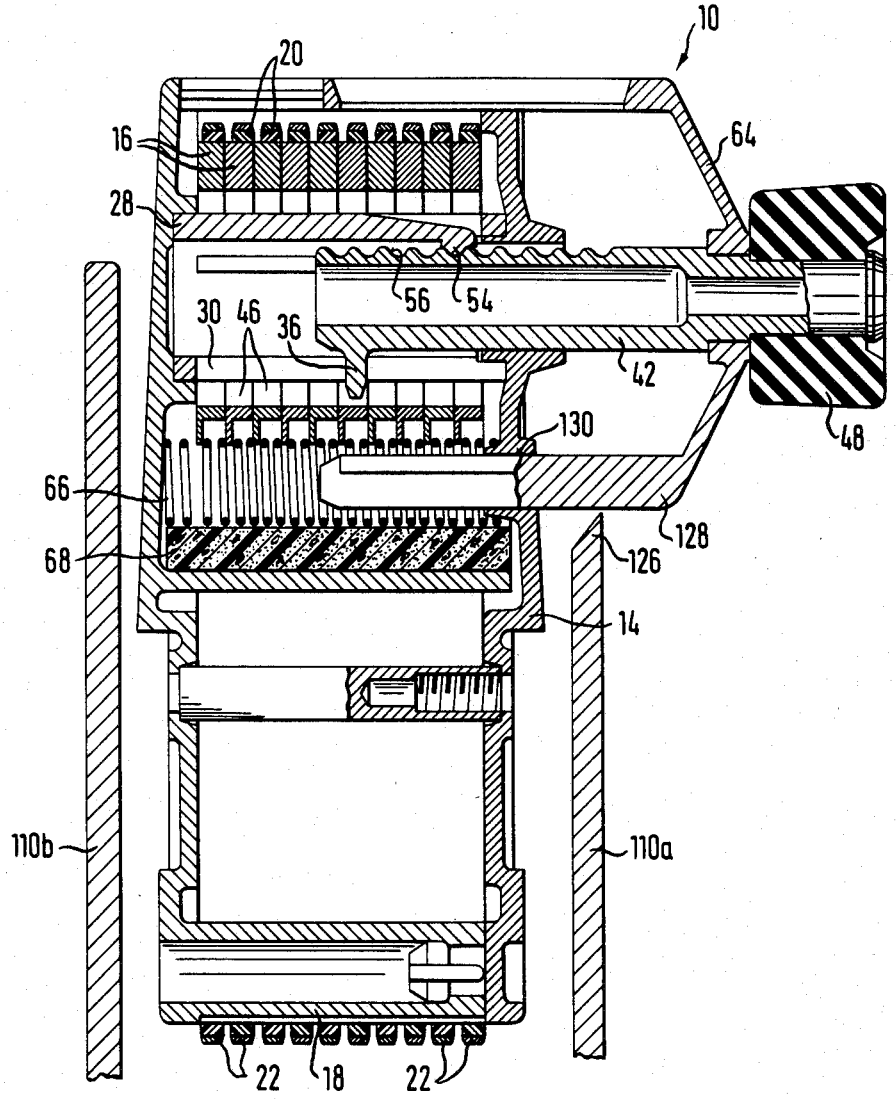

An example of embodiment of the invention will now be explained with reference to the drawings, wherein:

FIG. 1 is a side elevation of the hand labeling device according to the invention, FIG. 2 is a section along the line II—II of FIG. 1, the setting shaft of the printing mechanism being extended by one increment, and FIG. 3 is a section similar to FIG. 2 but with the setting shaft of the printing mechanism further extended.

The hand labeling device illustrated in FIG. 1 comprises a grip 108 which is disposed at the rear end of a housing 110. At the top of the housing 110 is a well 112 serving to receive a supply roll 114 of the carrier tape carrying the self-adhesive labels. The carrier tape is fed in the device from the supply roll 114 downwardly in the direction towards the front edge 115. It is guided over a printing platen 118 at the front edge of which it is deflected in an acute angle so that the self-adhesive labels are detached from the carrier tape and reach a position in which they can be applied to articles.

Beneath the grip 108 there is an operating lever 120 which is rotatably mounted about a shaft 119 and with the aid of which all the operations taking place in the device, such as the feeding of the carrier tape and the printing, can be carried out. To actuate the device the operating lever 120 is pulled against the force of a spring 121 against the grip 108 and then released again. A printing mechanism 10 attached in the front region of the housing 110 to an extension of the operating lever 120 moves, when the latter is pulled, in the direction of the arrow 122 against the printing platen 118; at the same time the printing types disposed in the printing position are wetted with ink by means of an inking device which is not illustrated. The self-adhesive label disposed on the printing platen 118 is thus imprinted by the impinging of the printing mechanism.

As apparent from FIGS. 2 and 3 the actuating knob 48 projects laterally at the housing 110 and in the housing side wall visible in FIG. 1 a cutout 124 is formed which permits movement of the printing mechanism 10 in the direction of the arrow 122 without the printing mechanism striking the housing wall. In FIGS. 2 and 3 the housing wall visible in FIG. 1 can be seen as housing wall **110*a* whilst the rear housing wall in the illustration is denoted by the reference numeral 110*b***.

In FIGS. 2 and 3 the structure of the printing mechanism 10 and its relative position to the housing walls **110*a* and 110*b* can be seen more exactly. The printing mechanism comprises as type carriers a plurality of adjacently disposed printing bands 20 led round setting wheels 16 and a deflection edge 18. The printing bands 20 are in a drive connection with the setting wheels 16**.

The setting wheels 16 are rotatably mounted on a sleeve 28 in which a setting shaft 42 is disposed which is axially displaceable and rotatable. Disposed on the setting shaft 42 is a tooth 36 which engages through a slot 30 in the sleeve 28 in recesses 46 which are disposed in the hub region of the setting wheels. On the setting shaft 42 it is also possible to dispose several teeth 36 which are at equal angular intervals and engage through corresponding further slots in the sleeve in recesses 46 of the setting wheels 16. These further teeth and slots are not visible in the sectional view of FIG. 2.

By axial displacement of the setting shaft 42 the tooth 36 can be brought into a drive connection with each of the setting wheels 16 so that each of the latter can be turned by turning the setting shaft 42. By the rotation of the setting wheels 16 the printing bands 20 can be moved so that the particular desired printing types 22 move into a printing position beneath the deflection edge 18. The turning of the setting shaft is facilitated by an actuating knob which is disposed on the end of the setting shaft 42 projecting from the housing.

To obtain an exact alignment of the plane of the tooth 36 with the plane of the particular setting wheel 16 to be adjusted a detent mechanism is provided which insures that the setting shaft on axial displacement thereof always engages in a manner clearly felt by the operator in positions in which a clear drive connection with a setting wheel 16 to be adjusted is established. This detent mechanism comprises a detent finger 54 integrally formed on the sleeve 28, said finger projecting radially inwardly at the sleeve inner surface and engaging in detent recesses 56 which are disposed in the outer peripheral surface of the setting shaft 42. A detent recess 56 is provided for each of the setting wheels 16 mounted on the sleeve 28. If in the arrangement of the individual parts illustrated in FIG. 2 in which the setting shaft 42 is in engagement with the second setting wheel 16 from the left the setting shaft 42 is moved to the right so that it comes into engagement for example with the next setting wheel 16 firstly the detent force exerted by the detent finger 54 on the setting shaft 42 must be overcome when it is moved out of the associated detent recess 56 upwardly in the illustration of FIG. 2; it can then drop into the next detent recess 56 which happens exactly when the setting shaft 42 is in engagement with the third setting wheel 16 from the left.

As apparent from FIG. 2 on the end of the setting shaft 42 projecting from the housing immediately adjoining the actuating knob 48 a cap 64 is disposed, the purpose of which is to ensure a smooth covering of the upper part of the printing mechanism 10.

To insure that on rotating the setting wheels 16 and the setting of the printing bands 20 thus made the operator performs the individual adjustment operations always until a printing type 22 is exactly in the printing position at the deflection edge 18, a further detent mechanism is provided which facilitates the exact adjustment for the operator. This detent mechanism consists of a helical spring 66 which is disposed parallel to the longitudinal axis of the setting shaft 42 at the periphery of the setting wheels 16 in such a manner that it partially penetrates into recesses at the periphery of the setting wheels 16. To enable the setting wheels 16 to be turned in spite of the engagement of the helical spring 66 in their recesses the helical spring 66 is mounted on a resiliently yieldable cushion 68. On turning of the setting wheels 16 the helical spring 66 can thus yield and embed itself in the cushion 68. The operator therefore feels on turning the setting wheels firstly an increase of the turning force to be applied, which then again decreases when the helical spring engages in the next recess at the periphery of the setting wheels just turned. The operator thus feels clear force peaks and knows that whenever he has overcome a force peak a printing type 22 is in the exact printing position beneath the deflection edge 18.

If the printing bands 20 of the printing mechanism 10 are to be adjusted with the aid of the actuating knob 48 in such a manner that certain characters are printed on the self-adhesive label disposed on the printing platen 118, the adjusting shaft 42 is brought successively into engagement with the individual setting wheels 16 and the setting wheel 16 in engagement with the setting shaft 42 can then be turned to adjust the printing bands 20. In FIGS. 2 and 3 two different positions of the setting shaft 42 are shown; in the position of FIG. 2 the second printing band 20 from the left and in the position of FIG. 3 the sixth printing band 20 from the left can be adjusted. To adjust the printing bands 20 at the extreme right the setting shaft 42 must be extended a long way out of the printing mechanism housing so that the actuating knob 48 and the cap 64 project to a great extent from the housing wall 110*a*. However, when using the hand labeling device it is undesirable to have parts projecting from the device with which the operator can strike other objects or be impeded. Such striking or impeding can result in damage to the printing mechanism. Although the operator is advised to insert the setting shaft 42 completely into the sleeve 28 again be pressing the actuating knob this instruction is not always carried out. In the device described here provisions are made for preventing the printing mechanism from being lowered for as long as the setting shaft 42 is extended a long way out of the sleeve 28.

The cutout 124 which is apparent in FIG. 1 in the housing wall 110*a* is so dimensioned that the setting shaft 42 with the cap 64 can be pulled laterally out of the housing 110 and the printing mechanism 10 in the inserted condition of the setting shaft 42 can be lowered through the distance necessary to imprint a self-adhesive label on the printing platen 118 without the setting shaft 42 or the cap 64 coming into contact with the housing wall 110*a*. If the setting shaft 42 is displaced in the sleeve 28 in the view of FIG. 2 to the right to such an extent that its teeth come into engagement with the second setting wheel 16 from the left, when the printing mechanism 10 is lowered against the printing platen 118 the inclined surface of the cap 64 strikes the housing wall 110*a* so that on further lowering of the printing mechanism 10 a return force must be exerted on the setting shaft 42 which displaces said shaft into the position completely inserted into the sleeve 28. Thus, if the setting shaft 42 was not completely inserted at the start of the printing operation by the cooperation of the upper end 126 of the housing wall 110*a* and the cap 64 it is automatically returned. The upper end 126 of the housing wall 110*a* can be made beveled as apparent from FIG. 2 so that the cap 64 is not damaged and transfer of the return force is facilitated. If the setting shaft 42 is extracted further from the sleeve 28 than illustrated in FIG. 3, where the teeth of the setting shaft 42 are in engagement with the sixth setting wheel 16 from the right, the labeling device can no longer be operated because when an attempt is made to lower the printing mechanism 10 against the printing platen 118 a pin 128 parallel to the setting shaft 42 and fixedly connected to the cap 64 strikes against the upper end 126 of the housing wall 110*a*. Thus, if the operator has forgotten to push the setting shaft 42 back in again after the extension and execution of the adjusting operations he is immediately reminded of this when he attempts to operate the labeling device by pulling the operating lever 120. Due to the striking of the pin 128 on the housing wall 110*a* the device is practically blocked and can only be operated again after the setting shaft 42 has been pushed in.

The pin 128 disposed on the cap 64 is displaced on displacement of the setting shaft 42 in a passage 130 in the housing half 14. Behind said passage 130 in the printing mechanism housing the helical spring 66 described in conjunction with FIG. 2 is located and its internal diameter is so large that it can readily receive the pin 128 without the latter obstructing the deformation of the helical spring on adjustment of the setting wheels 16.

The pin 128 is approximately T-shaped in cross-section which apart from saving material gives improved stiffness of the pin 128 in the direction in which it is stressed when it strikes against the end 126 of the housing wall 110*a* when an attempt is made to actuate the labeling device when the setting shaft is extended.

I claim:

1. Hand labeling device for imprinting and dispensing self-adhesive labels comprising a housing, a printing mechanism which is movable therein between a raised inoperative position and a lowered printing position and which comprises a plurality of axially adjacent setting wheels with which type carriers carrying printing types are in a drive connection, and a setting shaft which extends in the direction of the axis of the setting wheels is connected to the printing mechanism, projects outwardly at a housing wall and is displaceable at a side face of the printing mechanism between an inserted position and an extended position and with the aid of which the setting wheels can be moved relatively to each other in such a manner that desired printing types on the type carriers move into a printing zone at the printing mechanism, characterized in that to the setting shaft (42) a stop body (128) extending parallel thereto is connected which is displaceable with the setting shaft (42) between an extended and an inserted position and that in the path which the stop body (128) describes in the extended position when the printing mechanism (10) is lowered into the printing position a stop edge (126) fixed with respect to the housing is disposed.

2. Hand labeling device according to claim 1, characterized in that the stop body is a pin (128) which is disposed at the edge of a plate-like cap (64) which is carried by the setting shaft (42) and covers a side face of the printing mechanism (10) in the region of the setting wheels (16) and that the stop edge (126) is the upper edge of the housing wall (110*a*) at which the setting wheel (42) projects outwardly.

3. Hand labeling device according to claim 2, characterized in that the cap (64) extends outwardly conically from the peripheral region of the setting wheels (16) towards the setting shaft (42).

4. Hand labeling device according to claim 3, characterized in that the stop edge (126) is beveled in adaptation to the conical form of the cap (64).

5. Hand labeling device according to claim 2, 3 or 4, characterized in that the pin (128) is disposed in the direction of the movement of the printing mechanism (10) from the inoperative position to the printing position beneath the setting shaft (42) and that the printing mechanism (10) has a recess for accommodating the pin (128) in the inserted condition.

6. Hand labeling device according to claim 1, characterized in that associated with the setting wheels (16) as detent mechanism for defining the various rotational positions is a helical spring (66) which is held in contact with the periphery of the setting wheels (16) and that the stop body (128) projects into the cavity defined by the helical spring (66).

* * * * *